US012329259B2

(12) United States Patent
Wang

(10) Patent No.: US 12,329,259 B2
(45) Date of Patent: Jun. 17, 2025

(54) LUGGAGE CASE

(71) Applicant: Alexander Wang, Wan Chai (HK)

(72) Inventor: Alexander Wang, Wan Chai (HK)

( * ) Notice: Subject to any disclaimer, the term of this patent is extended or adjusted under 35 U.S.C. 154(b) by 28 days.

(21) Appl. No.: 18/179,328

(22) Filed: Mar. 6, 2023

(65) Prior Publication Data

US 2024/0298762 A1 Sep. 12, 2024

(51) Int. Cl.

| | |
|---|---|
| ***A45C 9/00*** | (2006.01) |
| ***A45C 5/02*** | (2006.01) |
| ***A45C 5/03*** | (2006.01) |
| ***A45C 5/14*** | (2006.01) |
| ***A45C 7/00*** | (2006.01) |
| ***A45C 13/04*** | (2006.01) |
| ***A45C 15/00*** | (2006.01) |

(52) U.S. Cl.

CPC ..... *A45C 9/00* (2013.01); *A45C 5/02* (2013.01); *A45C 5/03* (2013.01); *A45C 5/143* (2013.01); *A45C 5/145* (2013.01); *A45C 7/0022* (2013.01); *A45C 13/04* (2013.01); *A45C 15/00* (2013.01)

(58) Field of Classification Search

CPC .... A45C 9/00; A45C 5/02; A45C 5/03; A45C 5/143; A45C 5/145; A45C 7/0022; A45C 13/04; A45C 15/00

See application file for complete search history.

(56) References Cited

U.S. PATENT DOCUMENTS

| | | | | |
|---|---|---|---|---|
| 3,256,896 | A * | 6/1966 | Cummins | E04H 6/04 160/159 |
| 5,988,323 | A * | 11/1999 | Chu | B60B 33/021 16/35 R |
| 7,058,997 | B1 | 6/2006 | Klinger | |
| 7,600,275 | B2 * | 10/2009 | Al-Sabah | A47C 29/003 5/6 |
| 7,698,756 | B1 * | 4/2010 | Chen | A47C 17/72 135/96 |
| 7,703,588 | B2 * | 4/2010 | Chiang | A45C 5/145 16/35 R |
| 9,266,393 | B2 * | 2/2016 | Yeo | B60B 33/025 |
| 9,867,437 | B1 | 1/2018 | Dohmann | |
| 10,308,423 | B1 * | 6/2019 | Cui | B65D 90/027 |
| 11,044,973 | B1 * | 6/2021 | Easterwood | A47G 9/10 |
| 11,105,087 | B1 * | 8/2021 | Bundy | E04H 15/38 |
| 11,672,314 | B2 * | 6/2023 | Rodriguez | A45C 5/03 190/108 |

(Continued)

FOREIGN PATENT DOCUMENTS

| | | |
|---|---|---|
| CN | 201316048 Y | 9/2009 |
| CN | 102551397 A | 7/2012 |

(Continued)

*Primary Examiner* — Tri M Mai

(74) *Attorney, Agent, or Firm* — Hinckley Allen & Snyder; Stephen Holmes

(57) ABSTRACT

A luggage case includes expansible sleeping compartment apparatus. The expansible sleeping compartment apparatus comprises at least two housing members which define a volume when closed together for receiving therein or thereon an expansible sleeping compartment in an unexpanded state. The expansible sleeping compartment apparatus is attached to at least one of said housing members. In an expanded state the surfaces of expansible sleeping compartment defines an enclosure with an opening for receiving a person therein.

13 Claims, 6 Drawing Sheets

(56) References Cited

U.S. PATENT DOCUMENTS

| | | | | |
|---|---|---|---|---|
| 2010/0175222 | A1* | 7/2010 | Fallshaw | B60B 33/0073 16/35 R |
| 2012/0167484 | A1* | 7/2012 | Bernard | A45C 7/0077 52/79.5 |
| 2013/0256072 | A1* | 10/2013 | Farhat | A47C 4/52 5/112 |
| 2019/0045937 | A1 | 2/2019 | Reynolds | |

FOREIGN PATENT DOCUMENTS

| | | | |
|---|---|---|---|
| CN | 205682691 | U | 11/2016 |
| CN | 109380841 | A | 2/2019 |
| CN | 109393694 | A | 3/2019 |
| CN | 209073868 | U | 7/2019 |
| DE | 202008000541 | U1 | 4/2008 |

* cited by examiner

LUGGAGE CASE

FIELD OF THE DISCLOSURE

The present disclosure relates to a luggage case, especially to a luggage case with expansible sleeping compartment apparatus.

BACKGROUND OF THE DISCLOSURE

In situations where a standard bed is not available for rest, people may need simple bedding. These occasions may occur during travel or often in the case of people who have no place to stay, for example, homeless.

Luggage beds have been proposed which provide storage space and a collapsible bed frame for lying down when extended. However, these luggage beds are relatively complicated to open and store the bed frame, which takes time and effort and is not easy to operate. In addition, these luggage beds, which do not provide a private sleeping space, resulting in less privacy. Especially at this time when covid-19 and contagious diseases are prevalent, it exposes users to the risk of infection.

Therefore, there is a need to provide improved luggage beds to address at least the above issues.

SUMMARY OF THE DISCLOSURE

Features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims.

In accordance with a first aspect of the present disclosure, there is provided a luggage case with expansible sleeping compartment apparatus. The expansible sleeping compartment apparatus comprises at least two housing members which define a volume when closed together for receiving therein or thereon an expansible sleeping compartment in an unexpanded state. The expansible sleeping compartment apparatus may be attached to at least one of said housing members. In an expanded state the surfaces of expansible sleeping compartment defines an enclosure with an opening for receiving a person therein.

The expansible sleeping compartment is supported by a frame and the frame may be an extendible accordion frame.

Optionally, the frame may be constructed by bars and joints.

The expansible sleeping compartment may be attached to the inner side of at least one of said housing members.

The expansible sleeping compartment apparatus in the unexpanded state may be received in a separate cavity disposed in the volume defined by the at least two house members.

The expansible sleeping compartment apparatus in the unexpanded state may be retained outside the volume defined by the at least two house members.

The expansible sleeping compartment may be extendible to a length of approximately the height of a person. The person may be an adult.

The expansible sleeping compartment has outer surfaces and inner surfaces. The outer surfaces are waterproof or resistant to wetting. The inner surfaces are thermal insulators.

In addition, a plurality of lockable wheels may be disposed at the housing member or housing members. Optionally, a plurality of lockable wheels are detachable from the luggage case. In use, the housing members of the luggage cases are positioned at an open position by the lockable wheels at locked positions and the expansible sleeping compartment is extended from the opening of the housing members.

A solar panel may be disposed at the housing member or housing members.

Optionally, a USB socket may be disposed on the housing member or housing members.

Optionally, one or more storage spaces may be disposed at the housing members of the luggage cases.

Optionally, the expansible sleeping compartment apparatus may have an opening, which aligns with one of said housing members.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended Figures. Understanding that these Figures depict only exemplary embodiments of the disclosure and are not therefore to be considered to be limiting of its scope, the principles herein are described and explained with additional specificity and detail through the use of the accompanying Figures.

Preferred embodiments of the present disclosure will be explained in further detail below by way of examples and with reference to the accompanying Figures, in which.

DETAILED DESCRIPTION OF THE PREFERRED EMBODIMENTS

Figure 1:
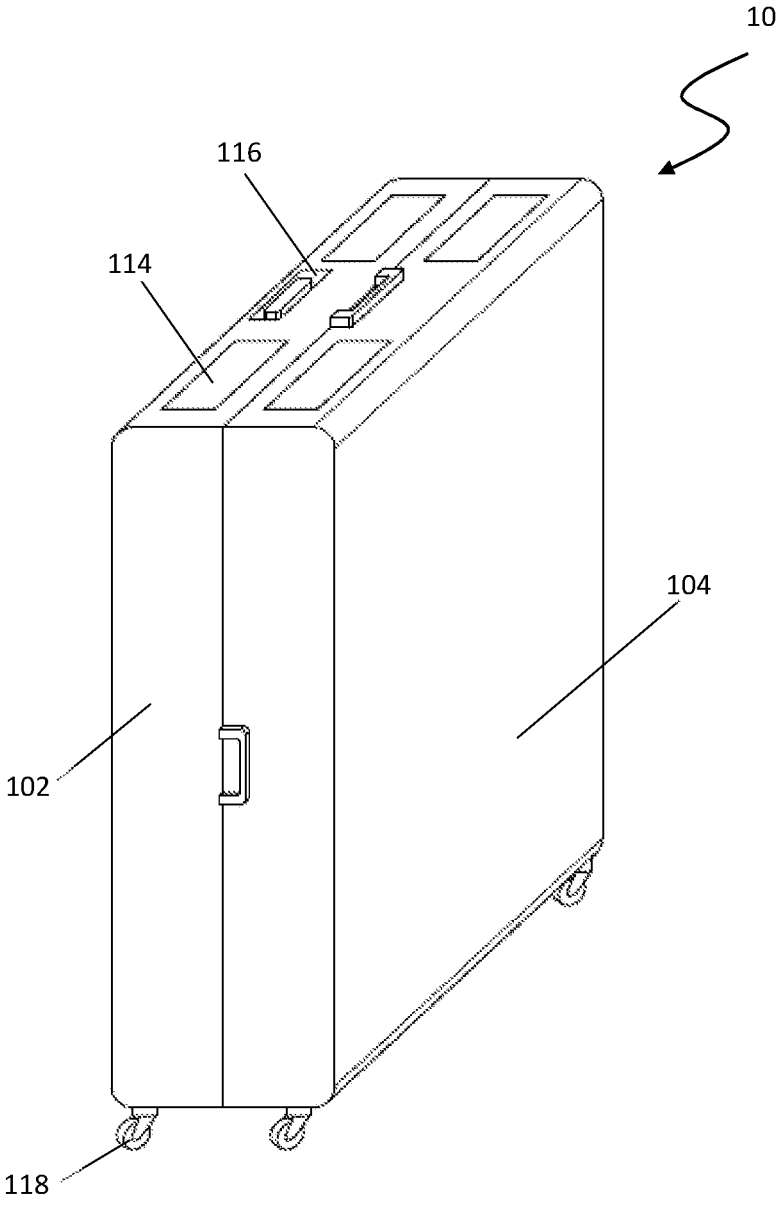
FIG. 1 shows a perspective view illustrating a luggage case according to an embodiment of the present disclosure where an expansible sleeping compartment apparatus is received within the luggage case.

Various embodiments of the disclosure are discussed in detail below. While specific implementations are discussed, it should be understood that this is done for illustration purposes only. A person skilled in the relevant art will recognize that other components and configurations may be used without departing from the spirit and scope of the disclosure.

In various embodiments of the disclosure, a luggage case with an expansible sleeping compartment apparatus is provided that may be beneficial for use in traveling or other situations where a standard bed is not available. The luggage case of the disclosure at least provides the effect of sheltering the bed, providing an isolated space, preventing insects and stains, facilitating the storage of the bed shelter, facilitating the use of pillows, providing more comfortable experience, and being convertible into a backpack to improve convenience.

Referring to the drawings, there is shown a luggage case with an expansible sleeping compartment apparatus.

Figure 2:
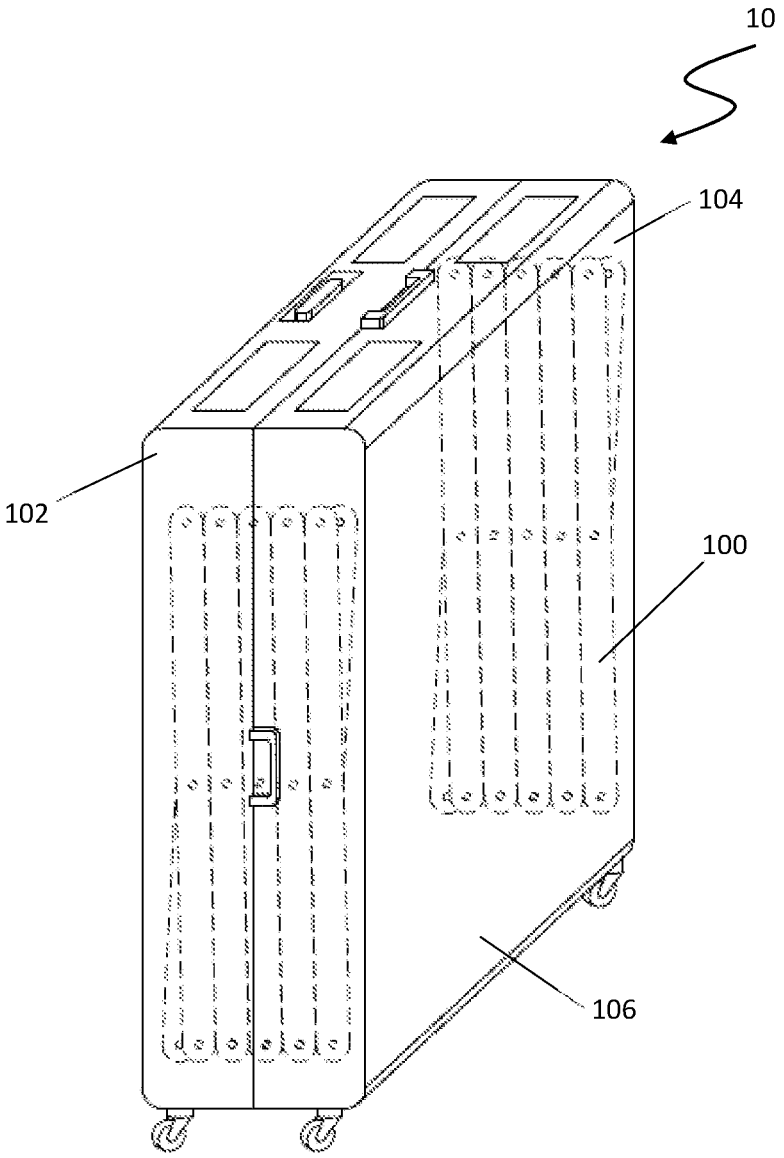
FIG. 2 shows a perspective view of the luggage case of FIG. 1 illustrating an expansible sleeping compartment apparatus is in an unexpanded state.
Figure 3:
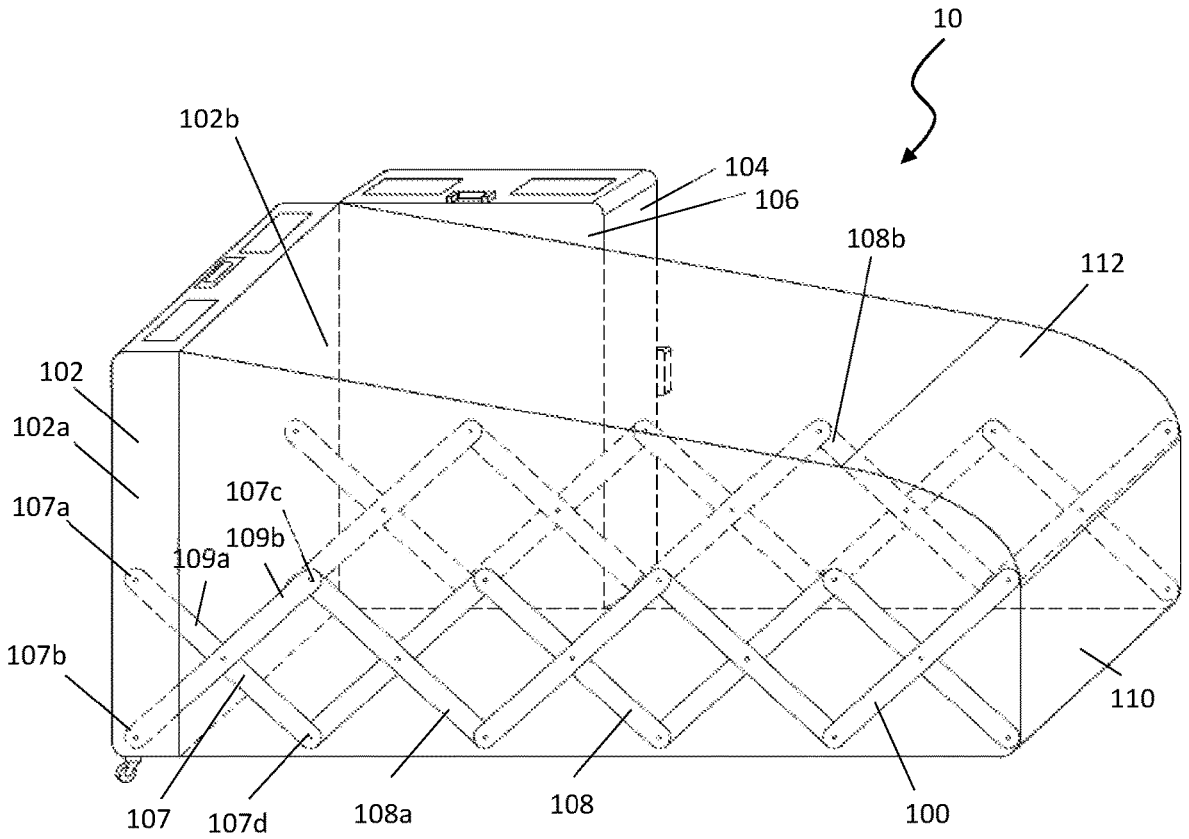
FIG. 3 shows a perspective view of the luggage case of FIG. 1 illustrating an expansible sleeping compartment apparatus is in an expanded state.

Referring now to FIGS. 1 to 3, perspective views of a luggage case 10 with an expansible sleeping compartment apparatus 100 are shown.

The luggage case 10 may include at least two housing members 102, 104 which define a volume 106. The two housing members 102, 104 may pivot along a vertical axis. When the two housing members 102, 104 are closed together, the volume 106 as shown in FIG. 2 in detail is for receiving the expansible sleeping compartment apparatus 100 in an unexpanded state. In this embodiment, the expansible sleeping compartment apparatus 100 may be configured to be attached to the inner side of at least one of said housing members 102, 104 by riveting, welding or bolting and the like or other means that securely affix the expansible sleeping compartment apparatus 100 to at least one of said housing members 102, 104. The expansible sleeping compartment in the unexpanded state may also be retained outside the volume defined by the at least two house members, as will be discussed below by referring FIG. 5.

In addition, the expansible sleeping compartment apparatus 100 may include a supporting frame 108 and outer surfaces 110*a* and inner surfaces 110*b*. The outer surfaces 110*a* may be waterproof or resistant to wetting and the inner surfaces 110*b* may be thermal insulators.

In one embodiment, the frame 108 may be an extendible accordion frame. In detail, the frame 108 may be constructed by bars and joints. The frame 108 may have two sets of bars and joints 108*a*, 108*b* which are attached to inner sides 102*a*, 102*b* of the housing members 102 respectively, parallel to each other and can be extended and retracted in the direction of substantially 90 degrees relative to the body of the luggage case. Each set of bars and joints 108*a*, 108*b* has a plurality of bars and joints constructed in "X" arrangements ("X" elements). For example an "X" element 107 of the set of bars and joints 108*a* may include two bars 109*a*, 109*b*. The two bars 109*a*, 109*b* of the "X" element 107 are attached to the inner side 102*a* of the housing member 102 by the points 107*a*, 107*b* which are separated by a predetermined distance; and the "X" element 107 may be engaged to an adjacent "X" element at the points 107*c*, 107*d*. The length of extension of the frame 108 may be limited by stoppers (not shown) disposed on the bars 108 and/or by the expansible length of the sleeping compartment apparatus 100. It can be understood that other configurations which could implement the same functions are also falling within the scope of this disclosure. When in an unexpanded state, the frame 108 (and the outer surfaces 110*a* and the inner surfaces 110*b*) is received within the volume 106 of the luggage case 10.

In use, the housing members 102, 104 of the luggage case 10 are positioned at an open position by the lockable wheels 118 at locked positions and the expansible sleeping compartment apparatus 100 is extended from the opening of the housing members, as shown in FIG. 3. The expansible sleeping compartment apparatus 100 may be extendible to a length of approximately the height of an adult. As shown in FIG. 3, when the expansible sleeping compartment apparatus 100 is in an expanded state, the frame 108 is extended or unfolded and the surfaces of expansible sleeping compartment apparatus 100 is supported by the extended frame 108. The surfaces of expansible sleeping compartment apparatus 100 define an enclosure 112 with an opening for receiving a person therein.

In one embodiment, the housing members 102, 104 of the luggage case 10 pivot along a horizontal axis.

The luggage case 10 may further have on at least one of the housing members 102, 104, at least one solar panel 114 and a USB socket 116 for collecting, storing solar energy and providing electronical charging to devices such as lights, mobile phones, tablets and the like. The solar panels and the USB socket can be provided on the top of the luggage case (as shown in FIGS. 1 to 3). It should be understood that solar panels and USB sockets can be provided on other sides of a luggage case. For example, solar panels and USB sockets can be provided on one side of a luggage case as shown in FIG. 4.

The luggage case 10 may also have more than one wheels 118 located on the bottom of at least one of the housing members 102, 104. In one embodiment, the wheels 118 are detachable from the luggage case 10.

Further chamber(s) may be provided within the luggage case 10 for storing and pull-out handle(s) (not shown) can be attached to the at least one of housing members, such that a user can access items easily.

Figure 4:
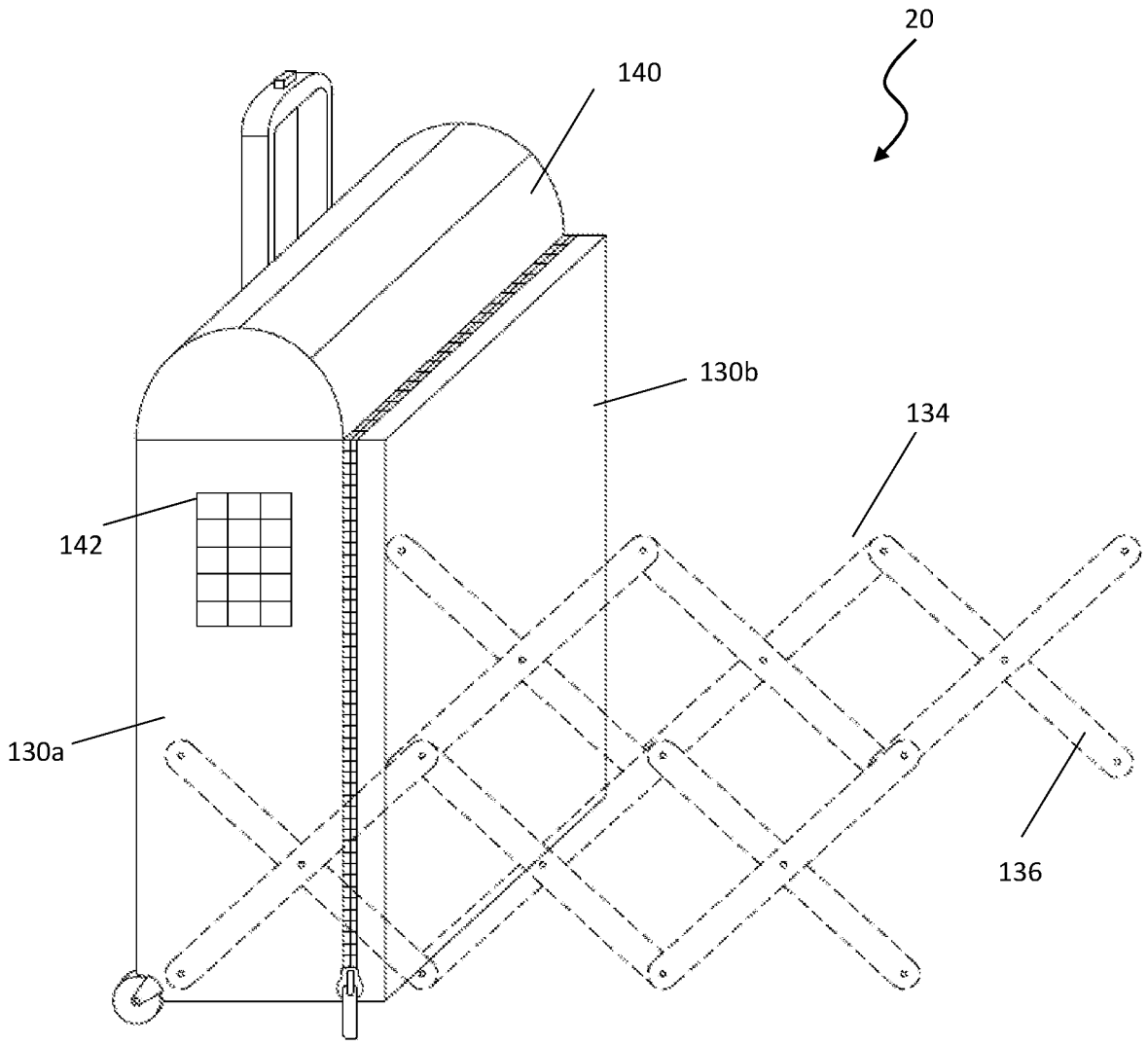
FIG. 4 shows a perspective view illustrating a luggage case according to another embodiment of the present disclosure.

FIG. 4 shows a perspective view illustrating a luggage case 20 according to another embodiment of the present disclosure. Different to the luggage case 10 of FIGS. 1 to 3, the luggage case 20 may include at least two housing members 130*a*, 130*b* which are engaged via a zipper type connection. The two housing members 130*a*, 130*b* may pivot to each other in a vertical direction or horizontal direction when disengaged with each other. It can be understood that ways known in the art, such as locks and latches, straps and bands, Velcro and magnets may be used to secure the housing members 130*a*, 130*b*. Similarly to the luggage case 10 as described above, an expansible sleeping compartment apparatus 134 of the luggage case 20, having a supporting frame, solar panels and USB sockets may be received within a volume defined by the at least two housing members 130*a*, 130*b*. A further chamber 140 may be provided on the top of at least one housing members 130*a*, 130*b* for storing items. Advantageously, the chamber 140 is accessible by the user when the sleeping compartment 134 is expanded. Solar panels 142 may be provided on at least one side of the luggage case 20.

Figure 5A:
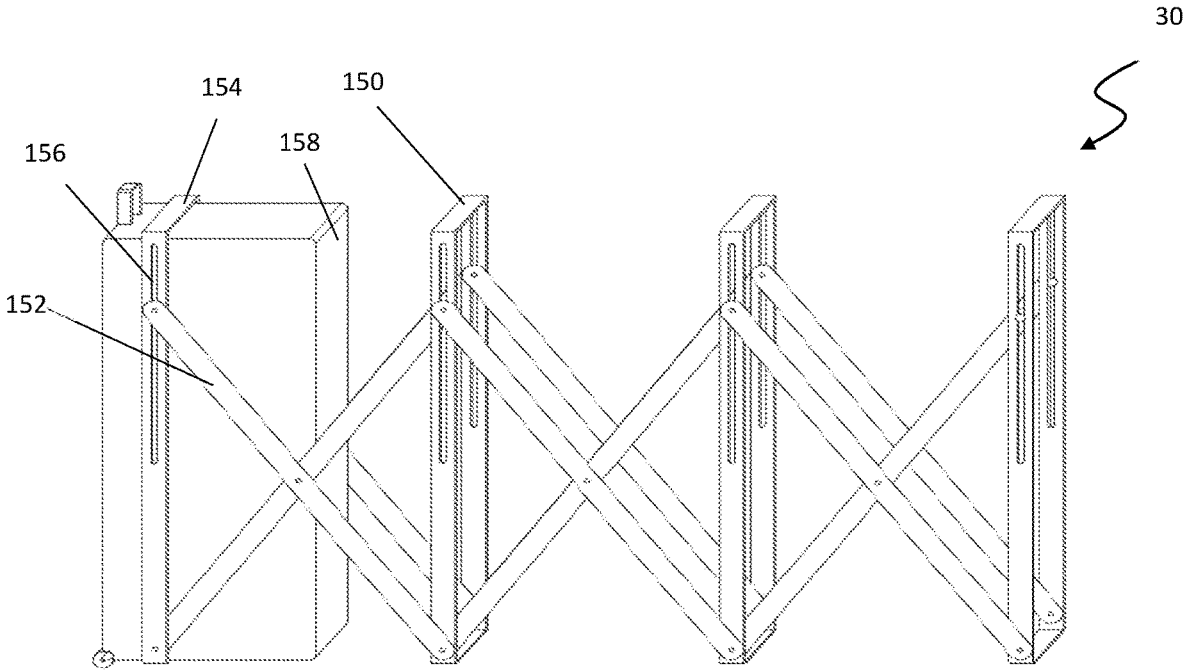
FIG. 5A shows a perspective view illustrating a luggage case according to a further embodiment of the present disclosure where an expansible sleeping compartment apparatus is received on outside of the luggage case.

FIG. 5A shows a perspective view illustrating a luggage case 30 according to a further embodiment of the present disclosure where an expansible sleeping compartment apparatus 150 is received or held on outside of the luggage case when in an unexpanded state. In this embodiment, the expansible sleeping compartment apparatus 150 may include a supporting frame 152 and at least one rim 154. The rim 154 may be located on the outside of the luggage and have grooves 156 on two sides, such that the supporting frame 152 is slidably moving upward and downward when the expansible sleeping compartment apparatus 150 is transforming between an unexpanded state and an expanded state. The expansible sleeping compartment apparatus 150 is sheathed with a foldable cover (not shown). The foldable cover may have outer surfaces and inner surfaces. The outer surfaces may be waterproof or resistant to wetting and the inner surfaces may be thermal insulators.

Figure 5B:
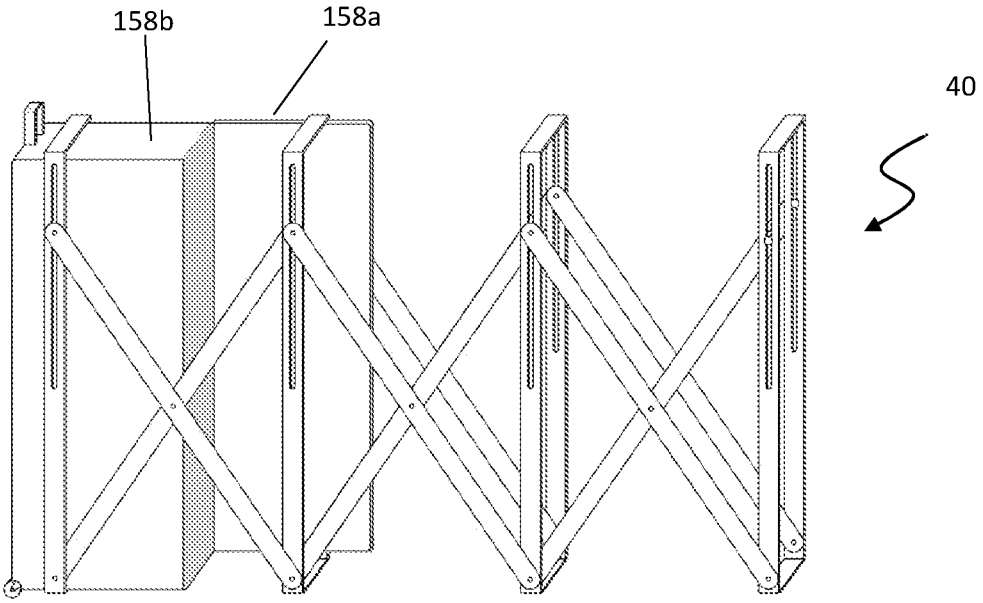
FIG. 5B shows a perspective view illustrating a luggage case according to an embodiment of the present disclosure where the luggage case has an opening.
Figure 5C:
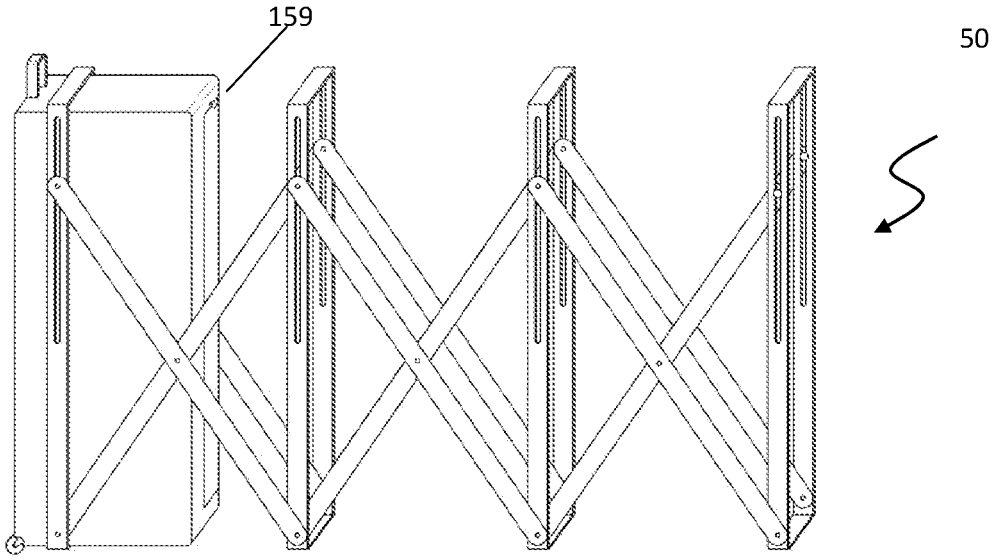
FIG. 5C shows a perspective view illustrating a luggage case according to an embodiment of the present disclosure where the luggage case has a lid.

In one embodiment, the end of the foldable cover has an opening for receiving a person inside the expansible sleeping compartment apparatus 150. Advantageously, in one embodiment as shown in FIG. 5B illustrating a luggage case 40, the opening aligns with housing member 158, and the housing member 158 may be accessed through the opening of the expansible sleeping compartment apparatus 150 or can be accessed directly when the expansible sleeping compartment apparatus 150 is in the unexpanded or collapsed state. The housing member 158 may have two housing members to form a volume, and the two housing members may be engaged via a zipper type connection or alike. In one embodiment as shown in FIG. 5B, one of the housing members may be a lid 158*a*, which may pivots along a horizontal axis or a vertical axis in relation to the other housing member 158*b* from an open position to a closed position. In one embodiment as shown in FIG. 5C illustrating a luggage case 50, the housing member 158 may have an opening, which may be closed via a zipper type connection 159, buttons, velcros, straps or other fasteners for the purpose of confining the contents inside the housing member 158. It can be understood that other configurations which could implement the same functions are also falling within the scope of this disclosure. In one embodiment, the opening may be disposed on other surfaces of the housing member 158.

In addition, when the luggage cases as discussed above are made of fabric, a pair of straps (not shown) may be removable affixed to the luggage cases, so that the luggage cases can be used as a backpack.

The above embodiments are described by way of example only. Many variations are possible without departing from the scope of the disclosure as defined in the appended claims.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A luggage case with expansible sleeping compartment apparatus comprising:

at least two luggage housing members which are pivotable relative to each other in a vertical direction and define an enclosed volume when closed together for receiving therein an expansible sleeping compartment in an unexpanded state;

the expansible sleeping compartment apparatus comprising an expansible frame being attached to at least one of said luggage housing members;

wherein the expansible sleeping compartment is attached to an inner side of one of said at least two luggage housing members;

wherein in an expanded state the expansible frame and surfaces of expansible sleeping compartment cooperate to define an enclosed space within the expansible frame and sleeping compartment for receiving a person therein; and wherein in an unexpanded state the expansible frame and said surfaces thereof are received and contained entirely within the enclosed volume defined by the at least two luggage housing members.

2. A luggage case with expansible sleeping compartment apparatus of claim 1, wherein the expansible sleeping compartment apparatus in the unexpanded state is received in a separate cavity disposed in the volume defined by the at least two house members.

3. A luggage case with expansible sleeping compartment apparatus of claim 2, wherein the expansible sleeping compartment is extendible to a length of approximately the height of a person.

4. A luggage case with expansible sleeping compartment apparatus of claim 3, wherein the person is an adult.

5. A luggage case with expansible sleeping compartment apparatus of claim 1, wherein the expansible sleeping compartment has outer surfaces and inner surfaces.

6. A luggage case with expansible sleeping compartment apparatus of claim 5, wherein the outer surfaces are waterproof or resistant to wetting.

7. A luggage case with expansible sleeping compartment apparatus of claim 5, wherein the inner surfaces are thermal insulators.

8. A luggage case with expansible sleeping compartment apparatus of claim 1, wherein the frame is an extendible accordion frame.

9. A luggage case with expansible sleeping compartment apparatus of claim 1, wherein the frame is constructed by bars and joints.

10. A luggage case with expansible sleeping compartment apparatus of claim 1, wherein a solar panel is disposed at the housing member or housing members.

11. A luggage case with expansible sleeping compartment apparatus of claim 1, wherein a USB socket is disposed on the housing member or housing members.

12. A luggage case with expansible sleeping compartment apparatus of claim 1, wherein one or more storage spaces are disposed at the housing members of the luggage cases.

13. A luggage case with expansible sleeping compartment apparatus of claim 1, wherein the expansible sleeping compartment apparatus has an opening, which aligns with one of said housing members.

* * * * *